United States Patent [19]

McKinzie

[11] 4,276,936

[45] Jul. 7, 1981

[54] METHOD OF THERMALLY INSULATING A WELLBORE

[75] Inventor: Howard L. McKinzie, Houston, Tex.

[73] Assignee: Getty Oil Company, Inc., Houston, Tex.

[21] Appl. No.: 80,228

[22] Filed: Oct. 1, 1979

[51] Int. Cl.[3] ..... E21B 36/00; E21B 43/24

[52] U.S. Cl. ..... 166/303; 166/57; 166/302

[58] Field of Search ..... 166/57, 278, 302, 303, 166/272; 52/727, 728

[56] References Cited

U.S. PATENT DOCUMENTS

| | | | |
|---|---|---|---|
| 895,612 | 8/1908 | Baker | 166/57 |
| 3,322,195 | 5/1967 | Brown et al. | 166/302 X |
| 3,360,046 | 12/1967 | Johnson et al. | |
| 3,379,253 | 4/1968 | Chism . | |
| 3,451,479 | 6/1969 | Parker . | |
| 3,525,399 | 8/1970 | Bayless et al. | 166/303 |
| 3,650,327 | 3/1972 | Burnside | 166/303 |
| 3,700,050 | 10/1972 | Miles | 166/57 X |
| 3,722,591 | 3/1973 | Maxson | 166/295 |
| 3,851,704 | 12/1974 | Maxson et al. | 166/292 |

OTHER PUBLICATIONS

Rose, *The Condensed Chemical Dictionary*, Fifth Edition, 1956, p. 915.

Perry, Robert H., *Chemical Engineers Handbook*, McGraw-Hill Book Co., Fifth Edition, 1973, pp. 20-64, 20-65.

*Primary Examiner*—Stephen J. Novosad
*Assistant Examiner*—George A. Suchfield
*Attorney, Agent, or Firm*—Arnold, White & Durkee

[57] ABSTRACT

A method of thermally insulating the borehole of a well in a thermal process for oil recovery by providing in the annular space between the casing and the well tubing a flowable, solid material having thermal insulating properties, such as vermiculite or perlite. Removal of the material is by fluidization thereof.

5 Claims, 1 Drawing Figure

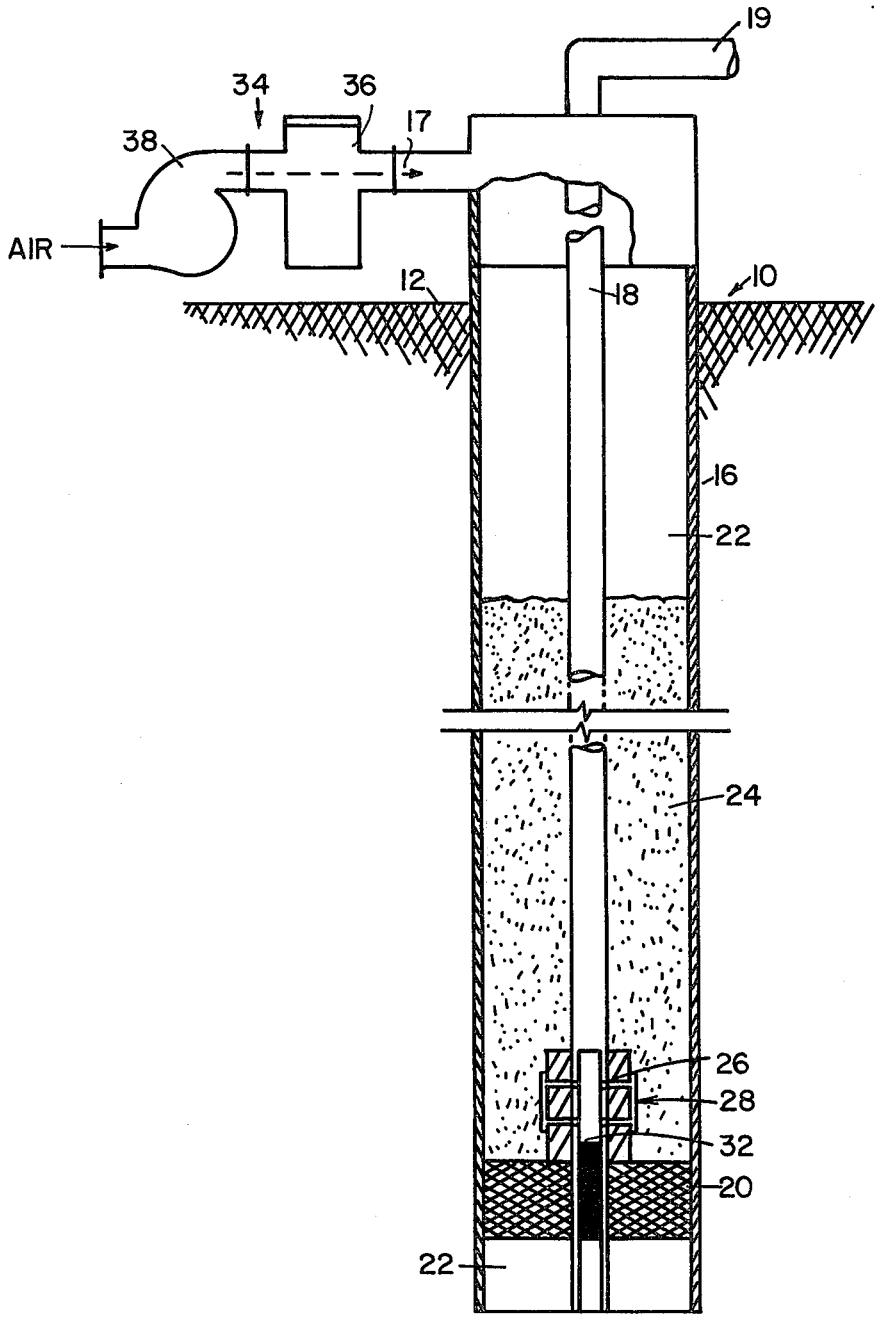
19
34
36
17
38
AIR
12
18
10
16
22
24
26
28
32
20
22

METHOD OF THERMALLY INSULATING A WELLBORE

BACKGROUND OF THE INVENTION

1. Field of the Invention

The present invention relates to a method of thermally insulating a wellbore.

2. Description of the Prior Art

Thermal stimulation has become a recognized enhanced recovery technique in the production of petroleum crude oil from wells. One form of thermal stimulation in prevalent use in the industry is steam injection. Injection of high temperature steam into the production zone, however, is not without problems. In particular, when steam is injected through a tubing string, there is substantial transfer of heat to and through the well casing. This causes a substantial loss of thermal energy as the steam travels through the tubing string, thus resulting in less efficiency in the recovery process. In fact, thermal losses may be so great that steam will condense before reaching the oil-bearing formation, rendering the recovery process almost totally ineffective in reducing the viscosity of the reservoir oil. This problem is more severe in deeper wells, and means in many contexts of use that steam injection processes may be impractical in all except very shallow wells. Additionally, heat transfer to the well casing can induce stresses in the casing which causes fracture of the casing.

Heat loss through the walls of a wellbore is also experienced in the recovery of geothermal energy from deep within the earth. Such heat loss diminishes the usefulness of such resource and mitigates its use.

Heretofore, it has been proposed to prevent excessive heat loss by various means of insulating the wellbore.

Insulation has been proposed by gelling crude in the annulus between the tubing string and the casing, by forming a polymerized foam silicate around the tubing string, or by using manufactured insulated pipe joints. None of these approaches has proved satisfactory.

Additionally, it has been proposed to insulate a well with a vermiculite slurry, as taught in U.S. Pat. No. 3,650,327 to Burnside, and to insulate with a cement slurry which includes vermiculite or perlite, as taught in U.S. Pat. No. 3,360,046 to Johnson, et al. However, when subsequent operations necessitate removal of the tubing string, the cured cement slurry or vermiculite slurry, which cannot be completely dried of the carrier liquid, may hinder removal. And removal of the vermiculite slurry from the annular space may be difficult to accomplish because the slurry may be sufficiently viscous that it cannot be readily displaced.

SUMMARY OF THE INVENTION

In accordance with the present invention, a wellbore is thermally insulated by providing in the annular space between the casing and the wellbore a flowable, solid insulating material. The insulating material may be one such as, for example, vermiculite and perlite. Furthermore, in accordance with the present invention, the solid insulating material is introduced into the annulus in the absence of a carrier liquid and is removed by fluidization of the material.

BRIEF DESCRIPTION OF THE DRAWING

The FIGURE shows a diagramatic representation of a vertical section of the earth in which there is a well containing a casing and a steam injection tubing string, and into which insulating material and removal means have been placed in accordance with a preferred embodiment of this invention.

DESCRIPTION OF AN ILLUSTRATIVE EMBODIMENT

The invention will be described with reference to an illustrative embodiment which constitutes the best mode known to the inventor at the time of this application.

Referring to the drawing, a well 10 is generally indicated, which is drilled from the surface of the earth 12 to an oil-bearing formation. The well has a casing string 16 that extends into the oil-bearing formation or to a point adjacent the formation. Casing 16 may be run and set in a conventional manner as by fixing the casing in place with cement. A tubing string 18 suitable for steam injection is disposed within the casing 16 and extends from the surface to the oil-bearing formation, defining an annular space 22 between the casing 16 and the tubing 18. A suitable sealing means such as the packer 20 is set on the tubing string and run into the well to seal the annular space 22 at a location which is desirably above the oil-bearing formation. The lower end of the tubing string desirably extends below the packer and has an opening which permits the flow of fluids through the tubing string between the surface and the oil-bearing formation.

The tubing string is desirably equipped with an inlet line 19 and the casing has an inlet line 17. The tubing 18 is also equipped with circulation means 26 for establishing fluid communication between the interior of the tubing string and the tubing-casing annulus 22 at a location above the packer 20.

The circulation means 26 may, for example, be a wireline actuated mandrel or sliding sleeve 27 having communication openings such as apertures 28 therein with an overlying screen 30 to prevent passage of solids into the tubing.

As shown in the FIGURE, a blanking plug 32 can be installed within tubing string 18 to block fluid flow between the interior of the tubing above the packer and the oil-bearing formation. Conventional wireline methods may be utilized to remove the plug when it is desired to reestablish such fluid communication.

In the practice of methods in accordance with this invention, a flowable solid material 24 having thermal insulation properties is provided and is introduced into the tubing-casing annulus 22 above the packer 20. The material 24 may be one chosen from a group comprising vermiculite and perlite; the material preferred for use by applicant at the time of this application is vermiculite.

The thermal insulation material is, in accordance with this preferred embodiment of the invention, introduced into the tubing-casing annulus without a carrier liquid.

The term "flowable" is used herein to denote that it is a solid material of a granular or particulate composition characterized by a property of free movement of the constitutent granules or particles in a continuous flow which is contemplated by the present invention.

The preferred material, vermiculite, is available in various grades or particle sizes. The range in U.S. Sieve No. for vermiculite particles is 3 to 70 (i.e. 0.265 inch to 0.0083 inch). For the purposes of its use in the method of the present invention, vermiculite in particles of an intermediate size (i.e. Sieve No. 8 to 40, or 0.094 inch to 0.166 inch) is preferred.

Introduction of the insulating material 24 into the tubing-casing annulus may be through casing inlet 17. If such manner of introduction is followed, plug 32 would be set in position within tubing 18 as shown and a pressure differential would be created between casing inlet 17 and inlet 19 to tubing 18. If a pressure differential is created, for example, by connection of a suction pump to tubing inlet 19, then insulating material 24 can be drawn or sucked through inlet 17 into the annulus 22 by reason of the communication provided by circulation means 26. Alternatively, a positive pressure pump adapted to forcibly inject flowable insulation material through inlet 17 into annulus 22 may be used to introduce the insulating material.

Also, if the upper end of casing 16 is adapted for separation from the embedded portion, whereby access may be had to annulus 22 by removal of the upper end, then the flowable insulating material could be introduced by pouring from a container.

As will be appreciated, packer 20 will prevent the material 24, regardless of the manner of introduction, from traveling below a predetermined depth in the tubing-casing annulus. The material 24 will be introduced in a sufficient quantity to substantially fill the entirety of the annular space 22.

More specifically, one suitable means of introduction of vermiculite into the tubing-casing annulus would be through use of pneumatic pumping equipment 34 having a holding container 36 connected to an external pump 38, whereby air can be pumped through the holding container 36. Vermiculite disposed in the container 36 would, upon the pumping of air, become entrained in the air stream exiting the container. The air stream containing vermiculite may, by means of appropriate duct work, such as a flexible hose or the like, be directed into the tubing-casing annulus or introduced into inlet 17 as shown.

For intermediate sizes of vermiculite particles (i.e. Sieve No. 8 to 40), the differential pressure required to be established between inlets 17 and 19 for introduction of the vermiculite into the tubing-casing annulus can be quite low and need be only about two p.s.i., although higher pressures are acceptable.

In an operation on well 10, after providing in the tubing-casing annulus to flowable solid material 24 and filling a portion of the annulus above packer 20 therewith, thermal energy is injected through tubing string 18 into the oil bearing formation penetrated by the well.

Removal of material 24 may be effected by fluidization of the material, as by entrainment in an air stream, floating the material on oil, water or drilling mud, or other means of fluidization. Removal by any one of such means would involve the establishment of a flow of material 24 out inlet 17. After insertion of plug 32 in tubing string 18, the fluidization medium (air, oil, mud, etc.) is introduced under pressure into inlet 19. The fluidization medium passing through apertures 28 travels upwardly through the tubing-casing annulus in a rapidly moving stream, causing the material 24 particles to become suspended therein such that flowing motion of the whole of material 24 toward inlet 17 is induced.

The foregoing description of the invention has been directed to a particular preferred embodiment for purposes of explanation and illustration. It is to be understood, however, that the foregoing is illustrative only and other structure and techniques can be employed in the practice of the present invention without departing from the teachings of the invention as defined in the following claims.

What is claimed is:

1. A well operation for a well having a tubing string suspended within a casing string, defining an annulus therebetween, with a packer disposed on the tubing string sealing the tubing-casing annulus above an oil-bearing formation which is penetrated by the well, which comprises the steps of:

filling substantially the entire length of the tubing-casing annulus above the packer with a flowable, solid material having thermal insulating properties introduced in the absence of a carrier liquid to thermally insulate the tubing string; and fluidizing the solid insulating material for removal from the tubing-casing annulus.

2. The method of claim 1 wherein the solid material is selected from the group consisting of vermiculite and perlite.

3. A method for thermally insulating a tubing string suspended in a cased wellbore, defining a tubing-casing annulus therebetween, with a packer disposed on the tubing string sealing the tubing-casing annulus above an oil-bearing formation which is penetrated by the well, which comprises the steps of:

entraining a flowable, solid material having thermal insulating properties in a stream of low pressure air;

directing the stream of air entrained material into the tubing-casing annulus; and filling a portion of the tubing-casing annulus above the packer with the flowable, solid material.

4. A well operation for a well having a tubing string suspended within a casing string, defining an annulus therebetween, with a packer disposed on the tubing string sealing the tubing-casing annulus above an oil-bearing formation which is penetrated by the well, which comprises the steps of:

filling a portion of the tubing-casing annulus above the packer with a flowable, solid material having thermal insulating properties, the material being introduced in the absence of a carrier liquid;

injecting thermal energy through the tubing string and into the formation; and fluidizing the solid insulating material by entrainment in an air stream, for removal from the tubing-casing annulus.

5. The method of claim 4 wherein the solid material is selected from the group consisting of vermiculite and perlite.

* * * * *

UNITED STATES PATENT AND TRADEMARK OFFICE

CERTIFICATE OF CORRECTION

PATENT NO. : 4,276,936

DATED : July 7, 1981

INVENTOR(S) : Howard L. McKinzie

It is certified that error appears in the above—identified patent and that said Letters Patent is hereby corrected as shown below:

Column 3, line 47, "to" should read -- the --.

Signed and Sealed this

*Fifth* Day of *January 1982*

[SEAL]

*Attest:*

GERALD J. MOSSINGHOFF

*Attesting Officer*

*Commissioner of Patents and Trademarks*